US006176192B1

(12) United States Patent
Torkler

(10) Patent No.: US 6,176,192 B1
(45) Date of Patent: Jan. 23, 2001

(54) DEVICE FOR ADJUSTING RAMPS

(75) Inventor: Heinz Torkler, Rothenfels (DE)

(73) Assignee: Mannesmann Rexroth AG, Lohr/Main (DE)

( * ) Notice: Under 35 U.S.C. 154(b), the term of this patent shall be extended for 0 days.

(21) Appl. No.: 09/355,224

(22) PCT Filed: Nov. 11, 1997

(86) PCT No.: PCT/EP97/06251

§ 371 Date: Jul. 20, 1999

§ 102(e) Date: Jul. 20, 1999

(87) PCT Pub. No.: WO98/32649

PCT Pub. Date: Jul. 30, 1998

(30) Foreign Application Priority Data

Jan. 24, 1997 (DE) ..... 197 02 417

(51) Int. Cl.[7] ..... B63B 21/00
(52) U.S. Cl. ..... 114/230.1; 14/69.5
(58) Field of Search ..... 114/70, 72, 230, 114/231, 258; 14/69.5, 71.1, 71.5, 71.7; 405/213

(56) References Cited

U.S. PATENT DOCUMENTS 5,623,889 * 4/1997 Whitener ..... 114/230.1

FOREIGN PATENT DOCUMENTS 1945420 9/1966 (DE) .
2900861 7/1980 (DE) .
3005145 8/1981 (DE) .
3104361 8/1982 (DE) .
3629842 3/1988 (DE) .
0094108 7/1985 (EP) .
0056230 7/1986 (EP) .
0245227 11/1987 (EP) .
0259719 3/1988 (EP) .
1498776 1/1978 (GB) .
2099083 12/1982 (GB) .

OTHER PUBLICATIONS

Deutsche Normen, Fluidtechnische Systeme und Geräte, Schaltzeichen, DIN ISO 1219, Aug., 1978 pp. 14, 19.

* cited by examiner

*Primary Examiner*—Jesus D. Sotelo
(74) *Attorney, Agent, or Firm*—Martin A. Farber

(57) ABSTRACT

In the case of ferries, floating bridges or the like, a bridge support and a ramp forming the connection to the bank are connected to one another pivotably via a pivot point. For adjusting the ramp incline, a differential cylinder is arranged between the bridge support and the ramp in the area of the pivot point. The piston surfaces of the differential cylinder are impinged upon with a pressure that adjusts itself in accordance with the respective loading of the ramp. The pressure in the cylinder chamber on the rod side is a measure of the bending moment in the connecting area of the ramp to the bridge support. A pressure limiting valve, serving as a safety valve, limits the pressure in the cylinder chamber on the rod side and consequently the bending moment in the connecting area of the ramp to the bridge support. The pressure limiting valve is arranged in a line connecting the two cylinder chambers directly to one another. When the pressure limiting valve responds, hydraulic medium is displaced out of the cylinder chamber on the rod side and fed to the cylinder chamber on the head side. Connected to the low-pressure side of the pressure limiting valve is a volume equalization container which provides a volume equalization between the hydraulic medium displaced out of the cylinder chamber on the rod side and the hydraulic medium required by the cylinder chamber on the head side when the pressure limiting valve responds and which takes up pressure medium from the cylinder chamber on the head side not required by the cylinder chamber on the rod side when the ramp is relieved of load. This device is used in the case of ferries, floating bridges or the like in which a bridge support, a ramp and a differential cylinder connected to them form a bending-resistant support.

7 Claims, 2 Drawing Sheets

DEVICE FOR ADJUSTING RAMPS

FIELD AND BACKGROUND OF THE INVENTION

The invention concerns a device for adjusting ramps on ferries, floating bridges or the like, in which the bridge support and the ramps forming the connection to the bank are connected to one another pivotably via a pivot point.

In particular for the bridging of shallow bank inclines, a ramp of adequate length that connects the bridge support to the bank is required. With a bending-resistant connection of the ramp to the floating bridge support, the great supporting length of this ramp leads to bending moments, which may assume undesirably high values or even inadmissibly high values.

A device for limiting the bending moment is known from DE 31 04 361 C2. In the area of the pivot point in which the ramp is pivotably connected to the bridge support there is arranged a differential cylinder, which serves for adjusting the ramp incline. For raising the ramp, hydraulic medium is fed to the cylinder chamber on the head side and hydraulic medium is thereby displaced out of the cylinder chamber on the rod side. For lowering the ramp, hydraulic medium is displaced out of the cylinder chamber on the head side and hydraulic medium is fed to the cylinder chamber on the rod side. If the ramp resting on the bank is subjected to loading, the pressure in the cylinder chamber on the rod side increases in a way corresponding to the loading. In this case, the pressure in the cylinder chamber on the rod side is a measure of the bending moment. Flanged onto the cylinder chamber on the rod side is a pressure limiting valve, which serves as a safety valve and is connected via a first line to the cylinder chamber on the rod side of a second differential cylinder. The cylinder chamber on the head side of the second differential cylinder is connected via a second line to the cylinder chamber on the head side of the first differential cylinder. If the bending moment, and consequently the pressure in the cylinder chamber on the rod side, exceeds a predetermined value, the pressure limiting valve responds. Hydraulic medium now flows out of the cylinder chamber on the rod side of the first differential cylinder into the cylinder chamber on the rod side of the second differential cylinder and displaces the piston of the latter. The hydraulic medium thereby displaced out of the cylinder chamber on the head side of the second differential cylinder is fed to the cylinder chamber on the head side of the first differential cylinder via the second line. In order that the ramp does not lift off the bank when relieved of the load following loading, provided parallel to the pressure limiting valve is a check valve, the direction of flow of which is opposite to that of the pressure limiting valve. If the ramp is relieved of load again, its own weight causes hydraulic medium to be displaced out of the cylinder chamber on the head side of the first differential cylinder into the cylinder chamber on the head side of the second differential cylinder. The hydraulic medium thereby displaced out of the cylinder chamber on the rod side of the second differential cylinder is fed via the check valve to the cylinder chamber on the rod side of the first differential cylinder. With this device it is possible to limit the bending moment. If—as in the known device—a differential cylinder is used for adjusting the ramp, means for volume equalization of the hydraulic medium are required. In the known device, the volume equalization takes place via the second differential cylinder, which has the same dimensions as the first differential cylinder. This solution is expensive, since the additional differential cylinder is required only for the volume equalization. The additional differential cylinder needs considerable space; furthermore the free end of its piston rod must be secured in such a way that it does not constitute a hazard. In the event of leakage losses between piston and inner wall of the differential cylinder, there is also the risk that the volume equalization is not permanently ensured in spite of identical differential cylinders. The use described in DE 31 04 361 C2 of a single differential cylinder for adjusting the ramp incline cannot be simply transferred to the use of two differential cylinders arranged in parallel for adjusting the ramp incline, since the pressure limiting valve can be directly flanged only onto one of two differential cylinders for adjusting the ramp incline.

SUMMARY OF THE INVENTION

The invention is based on the object of providing a low-cost device of the type stated at the beginning.

By the invention the volume equalization container does not need to take up the entire hydraulic medium displaced out of the cylinder chamber when the safety valve responds, but only the amount corresponding to the rod volume. In this respect, it is also not necessary for the entire volume of the piston rod to be taken into account within the hydraulic cylinder, instead it suffices to take into account only the path which the piston rod can cover as a maximum when the safety valve responds. The volume equalization container can consequently be chosen to be smaller than the hydraulic cylinder serving for adjusting the ramp incline. The volume equalization container need not be adapted exactly to the dimensions of the hydraulic cylinder. It suffices if the receiving volume of the volume equalization container exceeds a minimum value, which is determined by the cross section of the piston rod and the path which the piston rod can cover as a maximum when the safety valve responds. Possible leakage losses, in particular between the piston and the inner wall of the hydraulic cylinder as well as via the adjacent valves, are equalized automatically by the hydraulic medium contained in the volume equalization container. The invention is therefore not restricted to differential cylinders but is also similarly of advantage for synchronous cylinders, which do not in themselves require any equalization of the rod volume, to make up possible leakage losses via these cylinders and adjacent valves.

Further advantageous features may also be used with the invention. A check valve arranged parallel to the safety valve prevents the ramp from lifting off the bank when relieved of load. A switching valve, which interrupts the connection between the safety valve and the volume equalization container during the desired raising and lowering of the ramp, prevents the volume equalization container from being impinged upon with the load pressure, in particular during the desired raising and lowering of the ramp. If, in the case of more than one hydraulic cylinder for adjusting the ramp incline, mutually corresponding cylinder chambers are connected to one another by a line in each case, the pressure in the interconnected cylinder chambers is equalized if there is unsymmetrical loading of the ramp in the longitudinal direction. Gas pressure accumulators are hydraulic components which are listed as available in various sizes at low cost. The pressure with which the gas pressure accumulator is pressurized can be chosen to be significantly lower than the load pressure in the cylinder chambers of the hydraulic cylinder. The pressure in the gas pressure accumulator is automatically supplemented each time it is desired to lower the ramp, that is to say also when pressing the free end of the ram against the bank. This ensures that the pressure in the gas pressure accumulator is adequately high before subjecting the ramp to loading. The maximum piston travel of the hydraulic cylinder is not used completely for the adjustment of the ramp incline, in order that a remaining path for bending-moment limitation is retained irrespective of the respective ramp incline.

BRIEF DESCRIPTION OF THE DRAWINGS

The invention is explained more specifically below with its further details on the basis of exemplary embodiments represented in the drawings, in which.

DETAILED DESCRIPTION OF THE PREFERRED EMBODIMENT

Identical components are provided with the same designations.

Figure 1:
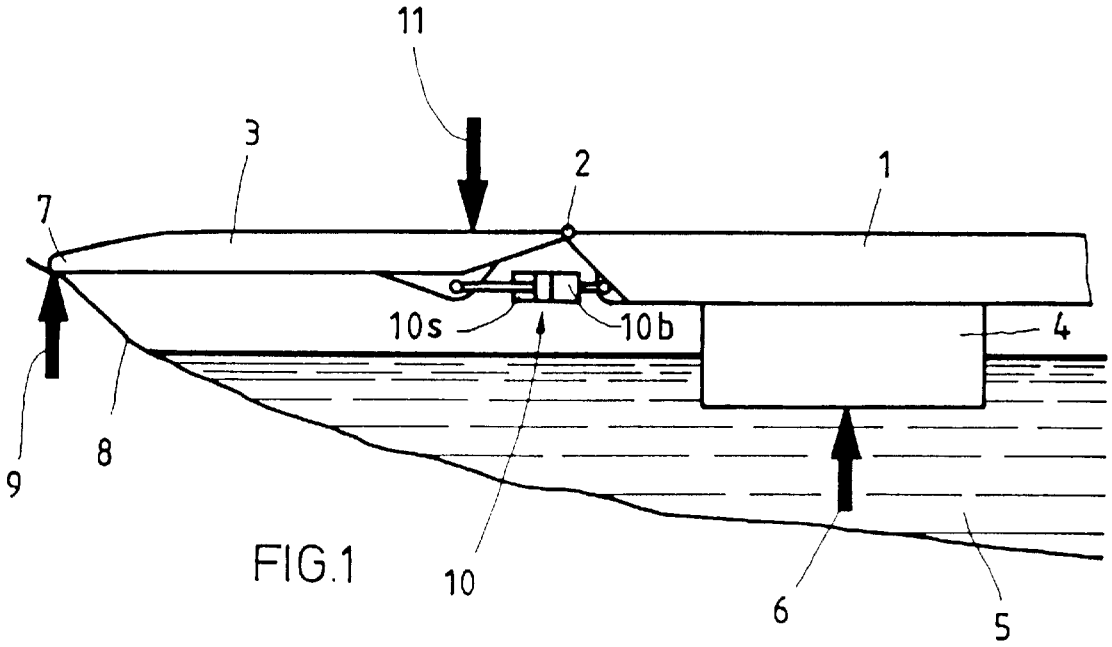
FIG. 1 shows a bridge support and a ramp connected to the latter via a pivot point, as a side view.

FIG. 1 shows a bridge support 1 and a ramp 3 connected to the latter via a pivot point 2, as a side view. The bridge support 1 is mounted on a float 4. The float 4 is submerged in the water 5 in a way corresponding to its loading. The buoyancy of the float 4 is summarized in an arrow 6. The ramp 3 rests with its free end 7 on a bank slope 8. The bearing force of the free end 7 of the ramp 3 is represented as arrow 9. A differential cylinder 10 with a cylinder chamber 10*b* on the head side and a cylinder chamber 10*s* on the rod side serves for adjusting the incline of the ramp 3. The pressure in the cylinder chamber 10*b* on the head side and in the cylinder chamber 10*s* on the rod side adjusts itself in a way corresponding to the loading of the ramp 3. The loading acting on the ramp 3 is summarized in an arrow 11. The bridge support 1, the ramp 3 and the differential cylinder 10 form a bending-resistant support. The pressure in the cylinder chamber 10*s* on the rod side is a measure of the bending moment in the connecting area of the ramp 3 to the bridge support 1.

Figure 2:
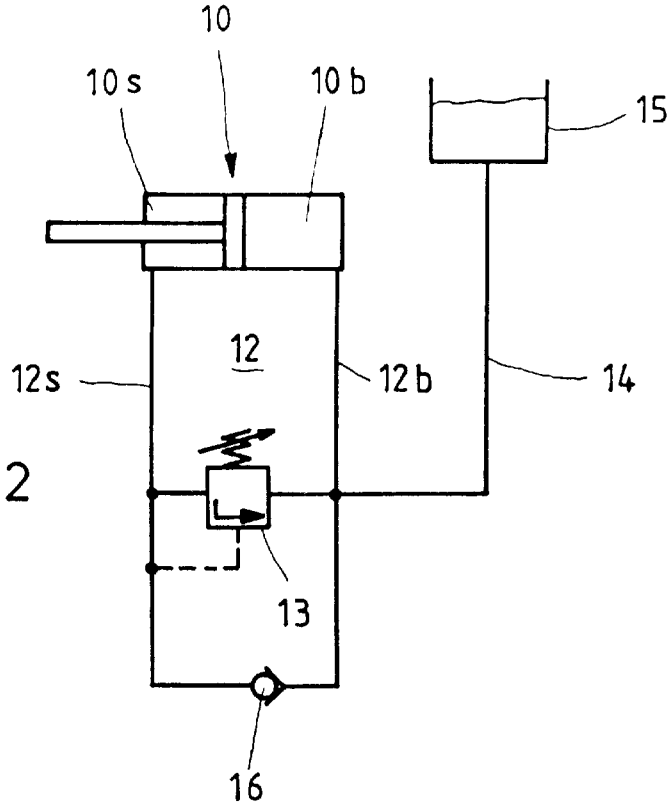
FIG. 2 shows a schematic representation of the device according to the invention for limiting the bending moment in the connecting area of the ramp to the bridge support.

FIG. 2 shows the device according to the invention for limiting the bending moment in the connecting area of the ramp 3 to the bridge support I in a schematic representation. Components which are provided for the desired raising and lowering of the ramp 3 are not represented. Likewise not represented in FIG. 2 are the bridge support 1 and the ramp 3, between which—as represented in FIG. 1—the differential cylinder 10 is arranged. A line 12 connects the cylinder chamber 10*s* on the rod side to the cylinder chamber 10*b* on the head side. Arranged in this line is a pressure limiting valve 13, serving as a safety valve. The response pressure of the pressure limiting valve 13 can be set in a known way. A first line portion 12*s* of the line 12 leads from the cylinder chamber 10*s* on the rod side to the pressure limiting valve 13. On the low-pressure side of the pressure limiting valve 13, a second line portion 12*b* of the line 12 leads to the cylinder chamber 10*b* on the head side. Connected to the low-pressure side of the pressure limiting valve 13, via a line 14, is an open container 15, which serves as a volume equalization container. The container 15 is only schematically represented in FIG. 2.

If the pressure in the cylinder chamber 10*s* on the rod side, which—as described above—is a measure of the bending moment, exceeds the response pressure of the pressure limiting valve 13, hydraulic medium is displaced out of the cylinder chamber 10*s* on the rod side. The hydraulic medium displaced out of the cylinder chamber 10*s* on the rod side flows into the cylinder chamber 10*b* on the head side, but is not sufficient to fill the cylinder chamber 10*b* on the head side completely. The hydraulic medium required for complete filling of the cylinder chamber 10*b* on the head side is sucked thereafter out of the container 15 via the line 14 and the line portion 12*b*. The differential volume, which is sucked thereafter out of the container 15, is equal to the product of the cross section of the piston rod of the differential cylinder 10 and the path which the piston rod covers during the response of the pressure limiting valve 13. As much hydraulic medium as is respectively required for the complete filling of the cylinder chamber 10*b* on the head side is sucked thereafter out of the container 15. Leakage losses between the piston and the inner wall of the differential cylinder 10 are thereby also automatically equalized at the same time.

Arranged between the line portions 12*b* and 12*s*, parallel to the pressure limiting valve 13, is a check valve 16. The direction of flow of the check valve 16 is opposite to the direction of flow of the pressure limiting valve 13. If the ramp 3 is relieved of load again, the float 4, and with it the ramp 3, begins to rise. In this case, hydraulic medium flows out of the cylinder chamber 10*b* on the head side via the check valve 16 back into the cylinder chamber 10*s* on the rod side, until the equilibrium between the forces 6, 9 and 11 is restored. This ensures that the ramp 3 does not lift off the bank slope 8 when relieved of load. The cylinder chamber 10*s* on the rod side cannot, however, receive as much hydraulic medium as is displaced out of the cylinder chamber 10*b* on the head side. The differential volume, that is to say that volume which exceeds the volume which the cylinder chamber on the rod side can receive, is fed to the container 15 via the line 14.

When there is renewed loading of the ramp 3 which leads to a response of the pressure limiting valve 13, and a subsequent relieving of the load on the ramp 3, the operations described above are repeated. When the ramp 3 is subjected to loading which leads to the response of the pressure limiting valve 13, the differential volume is taken from the container 15 and fed again to the container 15 when the ramp 3 is relieved of load.

Figure 3:
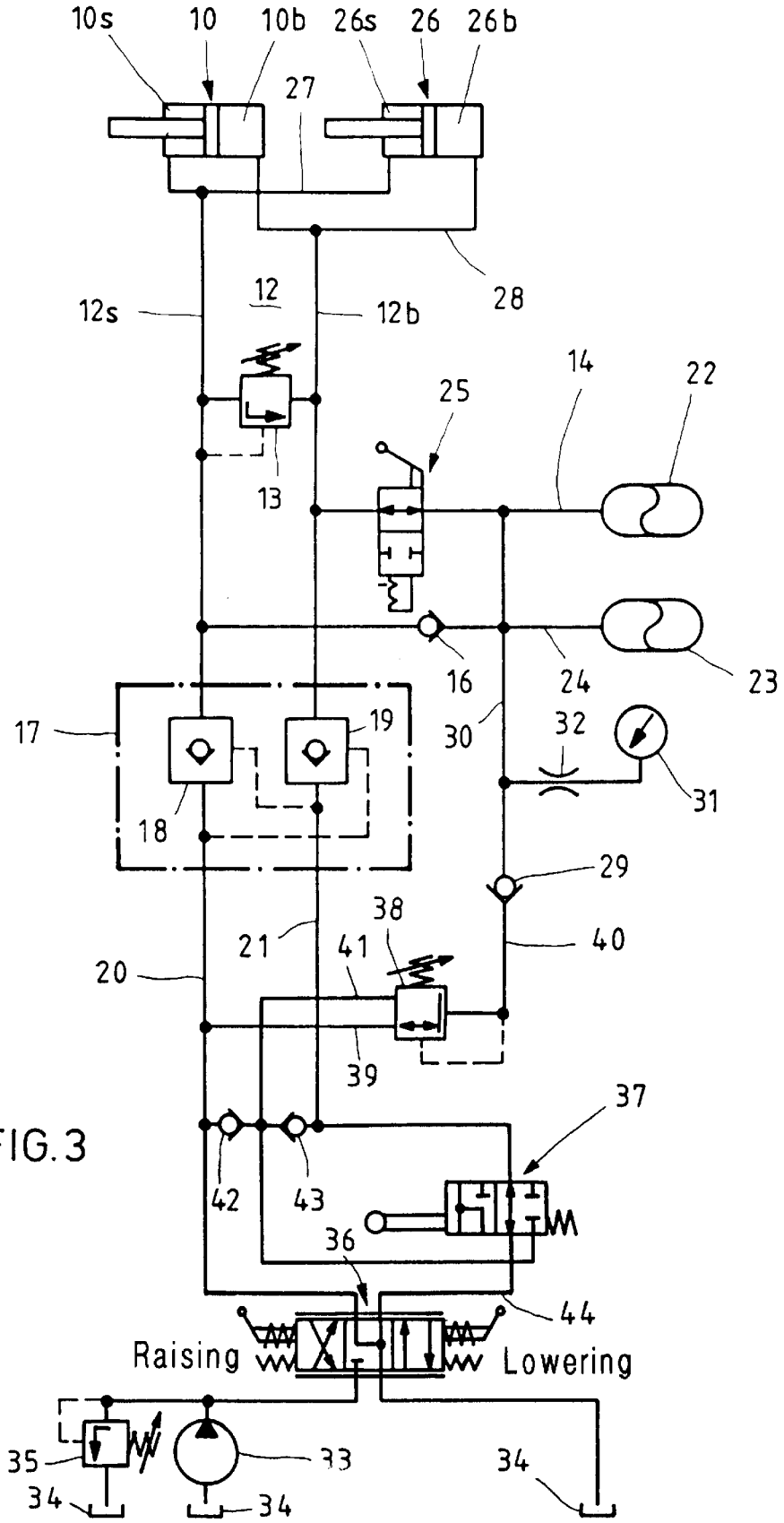
FIG. 3 shows a representation extended with respect to FIG. 2 of the device according to the invention for limiting the bending moment in the connecting area of the ramp to the bridge support.

Only the limitation of the bending moment when a predetermined loading of the ramp 3 is exceeded and the ramp 3 is subsequently relieved of load was described with reference to FIGS. 1 and 2. FIG. 3 shows a representation extended with respect to FIG. 2 of the device according to the invention for limiting the bending moment in the connecting area of the ramp.

FIG. 3 shows the operating state for a bending moment limitation in which the ramp is kept in its position. A valve arrangement 17 with unblockable check valves 18 and 19 prevents hydraulic medium from flowing out of the line portion 12*s* into a line 20 or hydraulic medium from flowing out of the line portion 12*b* into a line 21 in this operating state. Serving as the volume equalization container are two low-pressurized gas pressure accumulators 22 and 23, which are connected via lines 14 and 24, respectively, to the low-pressure side of the pressure limiting valve 13. The accumulating volume of the gas pressure accumulators 22 and 23 can also be combined in one gas pressure accumulator or be divided between more than two gas pressure accumulators. Arranged between the low-pressure side of the pressure limiting valve 13 and the gas pressure accumulators 22 and 23 is a switching valve 25. In the operating state considered, the switching valve 25 connects the line portion 12*b* to the lines 14 and 24, respectively, leading to the gas pressure accumulators 22 and 23. During the desired raising or lowering of the ramp 3, the switching valve 25 is in the other position, and interrupts the connection between the pressure limiting valve 13 and the gas pressure accumulators 22 and 23. This operating state is described further below.

Arranged parallel to the differential cylinder 10 is a second differential cylinder 26. The cylinder chamber on the rod side of the second differential cylinder 26 is designated by 26*s* and the cylinder chamber on the head side is designated by 26*b*. The cylinder chambers 10*s* and 26*s* on the rod side are connected to one another via a line 27, and the cylinder chambers 10*b* and 26*b* on the head side are connected to one another via a line 28. The lines 27 and 28 provide a pressure equalization in the cylinder chambers on the rod side and in the cylinder chambers on the head side, respectively. If need be, further differential cylinders can be connected in the same way to the lines 27 and 28. The pressure limiting valve 13 is connected via the line portion 12*s* to the line 27 and via the line portion 12*b* to the line 28. A check valve 29, which is connected via a line 30 to the lines 14 and 24, prevents hydraulic medium from flowing out of the gas pressure accumulators 22 and 23 in the operating state considered. A pressure gauge 31, which is connected via a restrictor 32 to the line 30 allows a monitoring of the pressure prevailing in the gas pressure accumulators 22 and 23.

If, when the ramp 3 is subjected to loading, the pressure in the cylinder chambers 10*s* and 26*s* on the rod side increases to such an extent that the pressure limiting valve 13 responds, hydraulic medium flows out of the line portion 12*s* into the line portion 12*b*. The check valves 18 and 19 of the valve arrangement 17 as well as the check valve 29 are in this case impinged upon in the blocking direction, so that no hydraulic medium flows away via these valves. Since the hydraulic medium displaced out of the cylinder chambers 10*s* and 26*s* on the rod side is not adequate to fill the cylinder chambers 10*b* and 26*b* on the head side completely, hydraulic medium out of the gas pressure accumulators 22 and 23 supplements the differential volume. When the ramp 3 is relieved of load, hydraulic medium out of the cylinder chambers 10*b* and 26*b* on the head side is fed via the check valve 16 to the cylinder chambers 10*s* and 26*s* on the rod side. Hydraulic medium not required by the cylinder chambers on the rod side is received again by the gas pressure accumulators 22 and 23. Possible leakage losses both between piston and inner wall of the differential cylinders 10 and 26 and via the check valves 18, 19 and 29 are made up automatically by the hydraulic medium accumulated in the gas pressure accumulators 22 and 23.

The device for adjusting the incline of the ramp 3 includes a pump 33, which delivers hydraulic medium from a tank 34. A pressure limiting valve 35 limits the pump pressure in a customary way to a value which can be set. A directional control valve 36, with four useful connections, serves for the desired raising and lowering of the ramp 3. In the position of rest of the directional control valve 36, the ramp 3 is kept in its position.

A switching valve 37 serves for limiting the ramp incline during the desired raising of the ramp 3, in order that the piston travel required for bending moment limitation is available as a remaining path in every position of the ramp 3. The control slide of the switching valve 37 is coupled with the ramp 3. If, during the desired raising, the ramp 3 reaches the greatest ramp incline operationally envisaged, the switching valve 37 is switched out of the position of rest, represented in FIG. 3, into the other switching position. If the greatest operationally achievable ramp incline is chosen, for example, such that it is 80% of the ramp incline that can be achieved as a maximum on the basis of the dimensions of the differential cylinders 10 and 26, 20% is still available as a remaining path for the limitation of the bending moment. The size of the remaining path required for bending moment limitation depends in practical application on the requirements which the bending moment limitation has to meet.

A reducing valve 38 is connected via a line 39 to the line 20. The outlet pressure of the reducing valve 38 is fed via a line 40 to the check valve 29. A line via which the reducing valve 38 can be connected to the tank 34 is designated by 41. From the line 41 there lead respective check valves 42 and 43 to the lines 20 and 21.

For the desired raising or lowering of the ramp 3, the switching valve 25 is to be switched into the position in which it interrupts the connection between the line portion 12*b* and the gas pressure accumulators 22 and 23. This switching operation may be performed manually or by a coupling of the actuating device of the directional control valve 36 with that of the switching valve 25.

In the "raising" position, the directional control valve 36 connects the pump 33 via a line 44, the switching valve 37, the line 21, the check valve 19, the line portion 12*b* and the line 28 to the cylinder chambers 10*b* and 26*b* on the head side. The pistons of the differential cylinders 10 and 26 are extended and the ramp incline is consequently increased. Hydraulic medium is returned from the cylinder chambers 10*s* and 26*s* on the rod side via the line 27, the line portion 12*s*, the check valve 18 that is unblocked by the pressure in the line 21, the line 20 and the directional control valve 36 to the tank 34. Since the pressure in the line portion 12*s* is greater than the pressure in the gas pressure accumulators 22 and 23, for example on account of correspondingly adapted check valve cross sections in the "raising" position of the directional control valve 36, the check valve 16 blocks. The connection between the line portion 12*b* and the gas pressure accumulators 22 and 23 is interrupted during the desired raising by the switching valve 25. If, during the desired raising of the ramp 3, the greatest operational ramp incline is reached, the switching valve 37 switches out of the position of rest over into the other switching position. In this switching position, the line 21 is indeed still connected to the line 44, but the lines 21 and 44 are additionally connected to the line 41. The line 41 is connected via the check valve 42 and the directional control valve 36 to the tank 34. No pressure can build up any longer in the line 21; the ramp 3 is not raised any further, although the directional control valve 36 continues to be in the "raising" position.

In the "lowering" position, the directional control valve 36 connects the pump 33 via the line 20, the check valve 18, the line portion 12*s* and the line 27 to the cylinder chambers 10*s* and 26*s* on the rod side. The pistons of the differential cylinders 10 and 26 are retracted and consequently the ramp incline is reduced. Hydraulic medium is returned from the cylinder chambers 10*b* and 26*b* on the head side via the line 28, the line portion 12*b*, the check valve 19 that is unblocked by the pressure in the line 20, the line 21, the switching valve 37, the line 44 and the directional control valve 36 to the tank 34. Since the pressure in the line portion 12*s* is greater than the pressure in the gas pressure accumulators 22 and 23, the check valve 16 blocks. The connection between the line portion 12*b* and the gas pressure accumulators 22 and 23 is interrupted during the desired lowering by the switching valve 25.

During the desired lowering, the pressure in the gas pressure accumulators 22 and 23 is automatically supplemented—if required. The pressure in the line 20 is reduced to the pressurizing pressure of the gas pressure accumulators 22 and 23. The pressurizing pressure of the gas pressure accumulators 22 and 23 is lower than the load pressure in the differential cylinders 10 and 26 approximately by a factor of 10. The line 41 is connected via the check valve 43, the switching valve 37, the line 44 and the directional control valve 36 to the tank 34. If the pressure in the gas pressure accumulators 22 and 23 is lower than the outlet pressure of the reducing valve 38, hydraulic medium continues to flow via the check valve 29 into the gas pressure accumulators 22 and 23 until the outlet pressure of the reducing valve 38 has adjusted itself again in them.

In order to connect the bridge support 1 to the bank slope 8 via the ramp 3, the ferry is brought into the vicinity of the bank slope 8 and the ramp 3 is lowered until its free end 7 rests on the bank slope 8. A pressing of the free end 7 of the ramp 3 is achieved by a further lowering of the ramp 3. The float 4 and the bridge support 1 are thereby raised slightly, while the free end 7 of the ramp 3 is supported on the bank slope 8 with the bearing force 9 increased. Consequently, the pressure in the gas pressure accumulators 22 and 23 is automatically supplemented—if required—also each time the free end 7 of the ramp 3 is pressed against the bank slope 8.

What is claimed is:

1. A device for adjusting ramps, in which a bridge support and the ramps forming a connection to a bank are connected to one another pivotably via a pivot point, comprising double-acting hydraulic cylinders arranged in the area of the pivot point for adjusting the ramp incline, piston surfaces of the hydraulic cylinders being impinged upon with a pressure that adjusts itself in accordance with respective loading of the ramp, a safety valve which limits loading-dependent pressure corresponding to bending moment in the connecting area of the ramp to the bridge support, wherein the safety valve (13) is arranged in a line (12) connecting two cylinder chambers (10*b*, 10*s*) directly to one another, and a volume equalization container (15; 22, 23) is connected to a low-pressure side of the safety valve (13).

2. The device as claimed in claim 1, wherein arranged parallel to the safety valve (13) is a check valve (16), a direction of flow of which is opposite to that of the safety valve (13).

3. The device as claimed in claim 1, wherein between the low-pressure side of the safety valve (13) and the volume equalization container (15; 22, 23) there is a switching valve (25), which interrupts the connection between the safety valve (13) and the volume equalization container (15; 22, 23) during the desired raising and lowering of the ramp (3).

4. The device as claimed in claim 1, wherein for adjusting the ramp incline, two double-acting hydraulic cylinders (10, 26) are arranged parallel to one another, corresponding cylinder chambers (10*s*, 26*s* and 10*b*, 26*b*, respectively) of the hydraulic cylinders (10, 26) being connected to one another in each case via a line (27 and 28, respectively) and the safety valve (13) being connected to the lines (27, 28), which connect the mutually corresponding cylinder chambers (10*s*, 26*s* and 10*b*, 26*b*, respectively) to one another.

5. The device as claimed in claim 1, wherein the volume equalization container is a low-pressurized gas pressure accumulator (22, 23).

6. The device as claimed in claim 5, wherein the outlet pressure of a pressure reducing valve (38), impinged upon by pressure during the desired lowering, is fed to the gas pressure accumulator (22, 23) via a check valve (29).

7. The device as claimed in claim 1, wherein during the desired raising of the ramp (3), a switching valve (37) actuated in dependence on the incline of the ramp (3) prevents further increasing of the ramp incline on reaching a predeterminable ramp incline which is lower than the ramp incline that can be achieved as a maximum.

* * * * *